US007921757B1

(12) United States Patent
Vavrick et al.

(10) Patent No.: US 7,921,757 B1
(45) Date of Patent: Apr. 12, 2011

(54) BODY ARMOR WITH ELECTRICAL POWER SUPPLY

(75) Inventors: Daniel J. Vavrick, Fredericksburg, VA (US); Nicholas V. Nechitailo, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 187 days.

(21) Appl. No.: 12/322,957

(22) Filed: Feb. 3, 2009

(51) Int. Cl.
*F41H 1/02* (2006.01)

(52) U.S. Cl. ..... 89/36.05; 89/907; 89/908; 2/2.5

(58) Field of Classification Search ..... 89/36.01, 89/36.05, 36.07, 36.08, 36.09; 2/2.5
See application file for complete search history.

(56) References Cited

U.S. PATENT DOCUMENTS

| | | | | |
|---|---|---|---|---|
| 5,472,769 | A | 12/1995 | Goerz, Jr. et al. | 428/138 |
| 5,554,816 | A * | 9/1996 | Skaggs et al. | 89/36.17 |
| 5,950,237 | A | 9/1999 | Micheron et al. | 2/69 |
| 6,012,162 | A * | 1/2000 | Bullat | 2/2.5 |
| 6,295,648 | B2 * | 10/2001 | Siman-Tov et al. | 2/2.5 |
| 6,338,292 | B1 * | 1/2002 | Reynolds et al. | 89/36.02 |
| 7,041,380 | B2 | 5/2006 | Yamashita et al. | 428/516 |
| 7,069,836 | B1 * | 7/2006 | Palicka et al. | 89/36.02 |
| 7,124,593 | B2 | 10/2006 | Feher | 62/3.5 |
| 7,146,899 | B2 * | 12/2006 | Imblum et al. | 89/36.01 |
| 7,180,302 | B2 * | 2/2007 | Kelsey et al. | 324/525 |
| 7,624,453 | B2 * | 12/2009 | Rene et al. | 2/2.5 |
| 7,805,767 | B2 * | 10/2010 | McElroy et al. | 2/2.5 |
| 2006/0012375 | A1 * | 1/2006 | Kelsey et al. | 324/525 |
| 2007/0245441 | A1 * | 10/2007 | Hunter | 2/2.5 |
| 2010/0315226 | A1 * | 12/2010 | Chu | 340/539.13 |

* cited by examiner

*Primary Examiner* — Bret Hayes
(74) *Attorney, Agent, or Firm* — Gerhard W. Thielman, Esq.

(57) ABSTRACT

An armor plate is provided for a body jacket to include provision for electrical power. The plate includes a flexible substrate, a ceramic cover disposed on the substrate, and a battery. The cover includes cavities along the substrate, with the battery disposed within the cavities. The battery comprises sheets disposed within the cavities. The battery includes a first metal layer disposed on the substrate, an electrolyte layer disposed on the first electrode layer and a second electrode layer disposed between the electrolyte layer and the cover.

5 Claims, 9 Drawing Sheets

0 μs

100 μs

200 μs

300 μs

0 μs

100 μs

200 μs

300 μs

BODY ARMOR WITH ELECTRICAL POWER SUPPLY

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to body armor integrated with electrical power sources. In particular, the invention relates to ceramic plates attached to jacket, the plates equipped with batteries embedded therein.

Infantry combatants, including soldiers and marines often wear body armor jackets as partial protection against small-arms fire. To provide reasonable levels of protection, such jackets are generally massive and bulky, thereby complicating mobility of their wearers. In addition, combatants typically carry equipment that requires an electrical power source, such as batteries. The additional weight and bulk of such batteries can further impede performance during combat operations.

Interceptor represents a more effective type of body armor than traditional bullet-proof vests to replace a previous version of body armor known as Personnel Armor System for Ground Troops (PASGT) fielded by U.S. armed forces. Materials for Interceptor were developed by DARPA in the 1990s, and a contract for production was awarded to DHB Industries' Point Blank Body Armor, Inc. by the U.S. Army Soldier Systems Center.

The Interceptor body armor system consists of an Outer Tactical Vest (OTV) and two Small Arms Protective Inserts (SAPI). The OTV is lined with finely woven Kevlar® aramid. These two parts of the vest are both bullet and heat resistant. The vest was tested to stop a 9-mm 124 GR full metal jacket bullet (FMJ) at 1,400 ft/s (426 m/s) with minimal deformation and has a V-50 of roughly 1,525 ft/s (465 m/s). Thus, the bullet must travel faster than 1,525 ft/s to have greater than a fifty-percent chance of breaking through the armor plates. These plates come in five different sizes and are disposed into the front and rear of the vest.

The Interceptor does not, however, represent a Level III-A vest, as the relevant military standard does not require protection against heavy .44 Magnum ammunition. However, both Level III-A and Interceptor vests do protect from much lighter 9-mm threats in identical tests. The Interceptor vest stops other, slower moving fragments and is also equipped with removable neck, throat, shoulder and groin protection components. The vest has a quick-release feature in which a quick tug would drop the plates off of the vest when necessary.

Two small-arms protective inserts may also be added to the front and back of the vest, with each plate designed to stop up to three 7.62×51 NATO rounds (.308 Winchester) with a muzzle velocity of 2,750 feet per second (838 m/s). The plates for incorporation into Interceptor provide the most technically advanced body armor fielded by the U.S. military, and are constructed of boron-carbide ceramic with a Spectra/Dyneema shield backing that breaks down projectiles and reduces their momentum before reaching the wearer.

The Interceptor armor also has attachment loops on the front of the vest which accommodate the same type of pockets used in the Modular Lightweight Load-carrying Equipment (MOLLE) backpack/carry vest system. This enables a soldier to tailor-fit his MOLLE and body armor system to satisfy mission requirements. Although not specifically designed for it, the loops can also easily attach MOLLE's predecessor, All-purpose Lightweight Individual Carrying Equipment (ALICE)-based equipment, as well as many pieces of civilian-made tactical gear. MOLLE also features a large handle on the back just below the collar that can be used to drag a wounded wearer to safety in an emergency. The Interceptor vest comes in various different camouflage patterns, including U.S. woodland, three-color desert, and Army Combat Uniform (ACU) patterns, as well as Coyote Brown.

The Interceptor Body Armor system weighs a total of 16.4 pounds (7.4 kg), with the vest weighing 8.4 pounds (3.8 kg), and two plates inserted weighing four pounds (1.8 kg) each. This is considerably lighter than the previous body armor fielded in Somalia (in 1993) weighing 25.1 pounds (11.4 kg) that most troops complained was too heavy and unwieldy for combat operations. The ceramic plates currently cost about $500 each. A complete Interceptor system costs $1,585.

Side-SAPIs are also available, along with the newer version of the vital plate, the Enhanced SAPI (E-SAPI). These two systems are becoming standard for forward deployed troops in Operation Enduring Freedom (OEF in Afghanistan) and Operation Iraqi Freedom (OIF) III. The E-SAPI plates are thicker and heavier than the normal SAPI armor, but offer increased protection from M-80 armor piercing ammunition. The Side-SAPI plates protects the side of the torso under the arm. With the Interceptor body armor, E-SAPI plates (10.9 lb), Side-SAPI plates (7.1 lb), and with the neck, throat and groin protectors installed the armor is significantly heavier than 16.4 pounds (7.44 kg).

Various contracts were negotiated to investigate reduced-weight armor plates, such as HQ0006-04-C-7046 with Triton Systems, Inc. The program made significant advances in achieving a low pound per square foot, low cost armor solution by using aluminum and aluminum composite backplanes with a silicon carbide hardface to meet the small arms threat.

Samples were fabricated, assembled into an armor system, and tested using a 7.62×63 mm M2AP round at an impact velocity of 2800 ft/sec. The armor system was compared to the rolled homogeneous armor (RHA) and rather expensive boron carbide ($B_4C$)—Kevlar system. The aluminum based backplane with SiC hard face has an areal density of seven-to-nine pounds-per-square-foot (psf) and a cost in the 100's$/$ft^2$ range for meeting the 7.62×63 mm M2AP threat.

A battery is a device that converts chemical energy directly to electrical energy consisting of one or more voltaic cells. Each voltaic cell includes two half cells connected in series by a conductive electrolyte. Each half-cell includes a positive electrode (cathode), and a negative electrode (anode). These do not physically contact each other but are immersed in a solid or liquid electrolyte. In a practical cell the materials are enclosed in a container, and a separator between the electrodes prevents the electrodes from coming into contact.

An electric cell may comprise two different metals separated by an electrolyte. A series of galvanic cells can be concatenated in series or in parallel electric circuits. Wet cells used liquid electrolytes that are vulnerable to leakage if not handled correctly. In another type of battery, the Absorbed Glass Mat (AGM) suspends the electrolyte in a fiberglass matting.

Portable rechargeable batteries can include several "dry cell" types, which are sealed units and are therefore useful in appliances like mobile phones and laptops. Cells of this type (in order of increasing power density and cost) include nickel-cadmium (NiCd), nickel metal hydride (NiMH), and lithium-ion ($Li^+$) cells. The voltage developed across a cell's terminals depends on the chemicals used in it and their concentrations. For example, alkaline and carbon-zinc cells both measure about 1.5 volts, due to the energy release of the associated chemical reactions. Because of the high electrochemical potential changes in the reactions of lithium compounds, lithium cells can provide 3 volts or more.

Primary batteries irreversibly transform chemical energy to electrical energy. Upon exhaustion of the initial supply of reactants, energy cannot be readily restored to the battery by electrical means. Secondary batteries can be recharged, i.e., have their chemical reactions reversed by supplying electrical energy to the cell, restoring their original composition.

SUMMARY

Conventional body armor plates yield disadvantages addressed by various exemplary embodiments of the present invention. In particular, various exemplary embodiments provide an armor plate for a body jacket to include provision for electrical power. The plate includes a flexible substrate, a ceramic cover disposed on said substrate, and a battery. The cover includes cavities along the substrate, and the battery comprises sheets disposed within the cavities. The battery includes a first metal layer disposed on said substrate, an electrolyte layer disposed on the first electrode layer and a second electrode layer disposed between the electrolyte layer and the cover.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The warfighter's ability to complete a military mission under hostile fire can be enhanced by reducing the weight of equipment to be carried into operation for combat or interdiction. This includes both reduced weight of electrical power sources, and in select cases reduced weight of body-armor. This can be achieved by combining these functions in exemplary embodiments of body armor system.

Various exemplary embodiments augment personnel armor protection with electrical power storage. This can be achieved by integrating chemical batteries with the ceramic armor plates. The benefits of this structural integration are as follows: (a) reduced weight of batteries due to reduced or eliminated casing from being carried separately, (b) increased performance of the body armor by primarily metal plate components of the batteries, and (c) redundancy of battery availability by parallel circuit distribution along the armor plates to avoid single-point-failure form incurred combat damage.

To reduce weight and cost in a preferred embodiment with improved performance, armor plates are provided as sandwiched or laminated structures containing outer silicon carbide plate and inner ductile metal plate electrodes. A thermoplastic or composite liner on the innermost surface can be placed to encase the battery and to provide for additional protection from fragments. Also, the liner provides for additional ductility, having been demonstrated to inhibit bullet penetration more efficiently. As an example of battery redundancy, each armor plate can be constructed as an independent armored battery, with five or six batteries per vest.

Various exemplary embodiments provide ceramic armor face plate (e.g., silicon carbide, boron carbide, etc.) with an internal cavity to contain a battery that employs metal plate electrodes and electrolyte. The innermost layer can be a rigid and stiff thermoplastic, or else a fiber-reinforced composite for enhanced armor ductility. Such materials can be used for improved resistance to bullets together with a liner to stop smaller fragments and debris.

Figure 1:
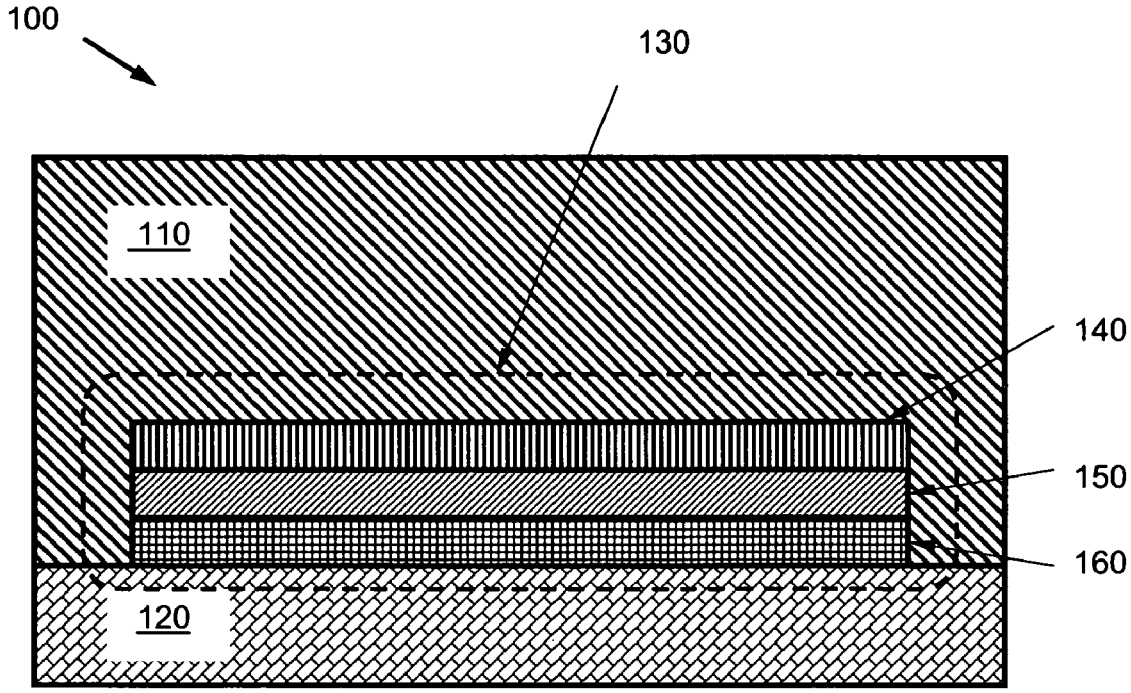
FIG. 1 is a first elevation cross-section view of a body armor plate.

FIG. 1 represents a first elevation material diagram 100 of the integrated battery armor plate. A ceramic plate 110 is disposed on a polymer-based substrate 120, such as composed of hard thermoplastic or fiber-reinforced composite. Within the ceramic plate 110 and contacting the substrate 120 is a thin cavity that contains a battery structure 130 that can supply direct-current electrical power.

The characteristic "thin" for the cavity relates to greater dimensions along directions in contact with and parallel to the plate 110 and substrate 120 than the thickness direction perpendicular thereto. The battery structure 130 is composed of a first electrode (e.g., anode) 140, an electrolyte 150 and a second electrode (e.g., cathode) 160. The substrate 120 contacts the second electrode 160, and the electrolyte 150 sandwiches between the electrodes 140, 160 that can be composed of metal plates.

The electrodes 140 and 160 can respectively be copper (Cu) plus zinc (Zn) or vice versa. Other metal combinations can include nickel (Ni) plus cadmium (Cd), silver (Ag) plus zinc, as well as lithium-cobalt-oxide ($Li\text{-}CoO_2$) plus titanium-sulfide (TiS) (lithium-ion) for a rechargeable version. The electrolyte can, for example, be a woven material saturated with a liquid acid typically, or with water in the case of silver and zinc, or a lithium salt for the lithium-ion versions.

Figure 2:
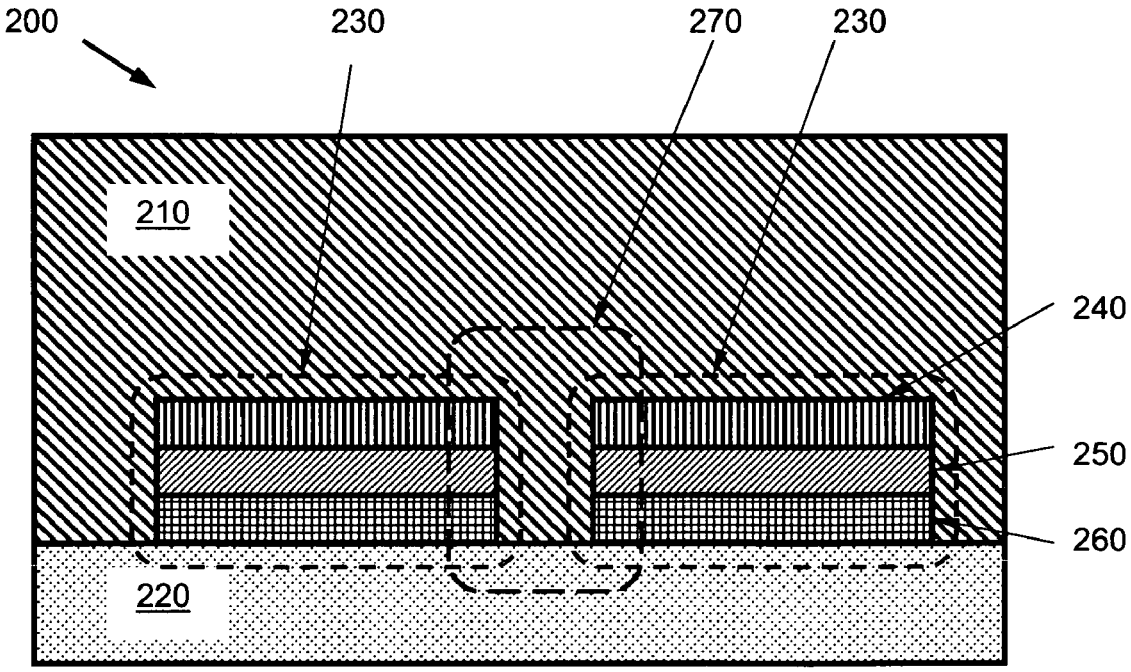
FIG. 2 is a second elevation cross-section view of a body armor plate.

FIG. 2 represents a first elevation material diagram 200 of the integrated battery armor plate. A ceramic plate 210 is disposed on a ductile liner 220. Within the ceramic plate 210 and contacting the liner 220 is a pair of structures 230 composed of a first electrode 240, an electrolyte 250 and a second electrode 260. The liner 220 contacts the second electrode 260, and the electrolyte 250 sandwiches between the electrodes 240, 260. The structures are separated by a ceramic region 270 to improve armor resistance to bullets and small fragments with localized increases in thickness. The battery structures 230 can be concatenated in series for higher voltage, or connected in parallel for greater redundancy.

Various exemplary embodiments provide ceramic plates with cavities and backing plates for improved overall armor system performance (via backplane stiffness and ductility). An armor system that includes a back plate composed of fiber-reinforced aluminum (Al) of reasonable ductility enables a silicon carbide (SiC) hardface system to perform equally as well as armor with a boron carbide ($B_4C$) hardface. The SiC hardface has one advantage of being many times less expensive than the $B_4C$ hardface.

In various exemplary embodiments, commercial batteries insertable within pockets of the plates 110 and 210 can serve as the respective layer structures 130 and 230. The rectangular BK062265 lithium-ion battery can be inserted into correspondingly shaped gaps within the plates and connected together in parallel and/or series circuits by appropriate ribbon cabling. This model has a total energy of 0.8 amp-hrs at 3.7 volts, weighing 25 grams (0.88 oz) with dimensions of 65 mm (2.56 in), 22 mm (0.87 in) and 6 mm (0.24 in). Alternatively, coin batteries, such as the CR2450 with a diameter of 24.5 mm (0.88 in) with high current draw of 30 milli-amps could be used without departing from the scope of the invention.

Alternatively, the armored batteries can be attached to a vehicle, enabling auxiliary use of these plates as a sensor. In particular, upon impact from a bullet causing damage to the plate, the location of the impact can be detected by degraded performance of the battery. Also, as alternative, the source of electric current can be a plate system generating electricity based on the temperature difference between the outside temperature and body temperature. Electro-strictive materials can be used to convert energy of vibration into electric energy. Similar configurations can be incorporated for vehicle armor.

The conventional body armor ceramic plate and the ceramic plate with added battery as described and embodied herein have substantially similar weights for the same volume. A copper (Cu) and zinc (Zn) matrix can form a truss cross-section of copper with triangular-cross-section filler elements of zinc.

Deformation studies have been conducted on axi-symmetric collision-impact numerical simulation with a solid 4030-steel conical projectile at 800 ft/s against two comparative plates both about twenty-five-percent thicker than the projectile: first, a solid $B_4C$ plate representing a conventional ceramic configuration; and second, a hybrid plate with a solid $B_4C$ fore-plate, a flexible rear-casing of rubber, and a truss matrix (that can include a battery) sandwiched therebetween. The fore and rear layers have approximately half the thickness of the projectile's length.

Figure 3A:
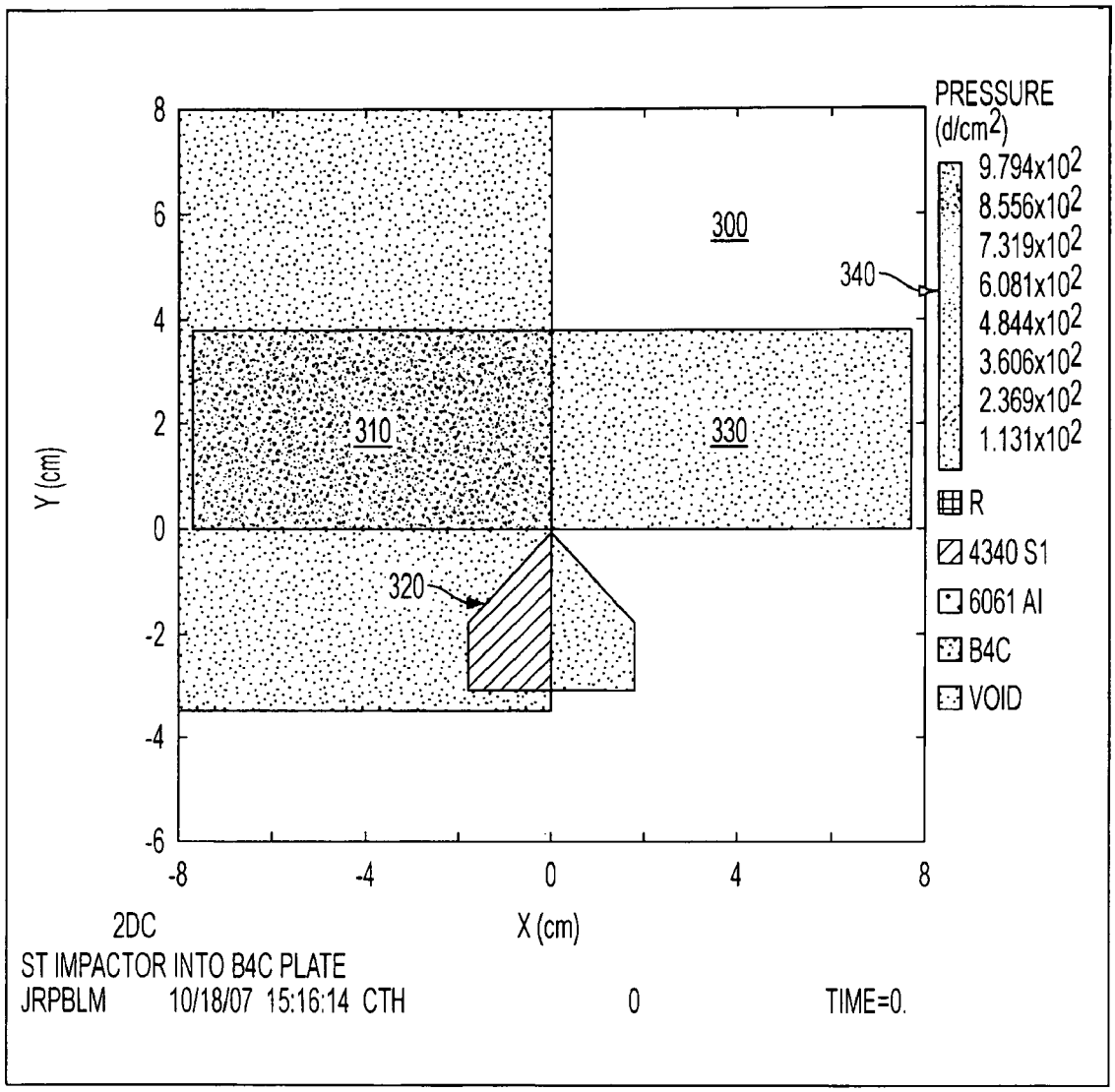
FIGS. 3A through 3D are elevation contour plots of time-elapse deformation of solid ceramic body armor plate.
Figure 3B:
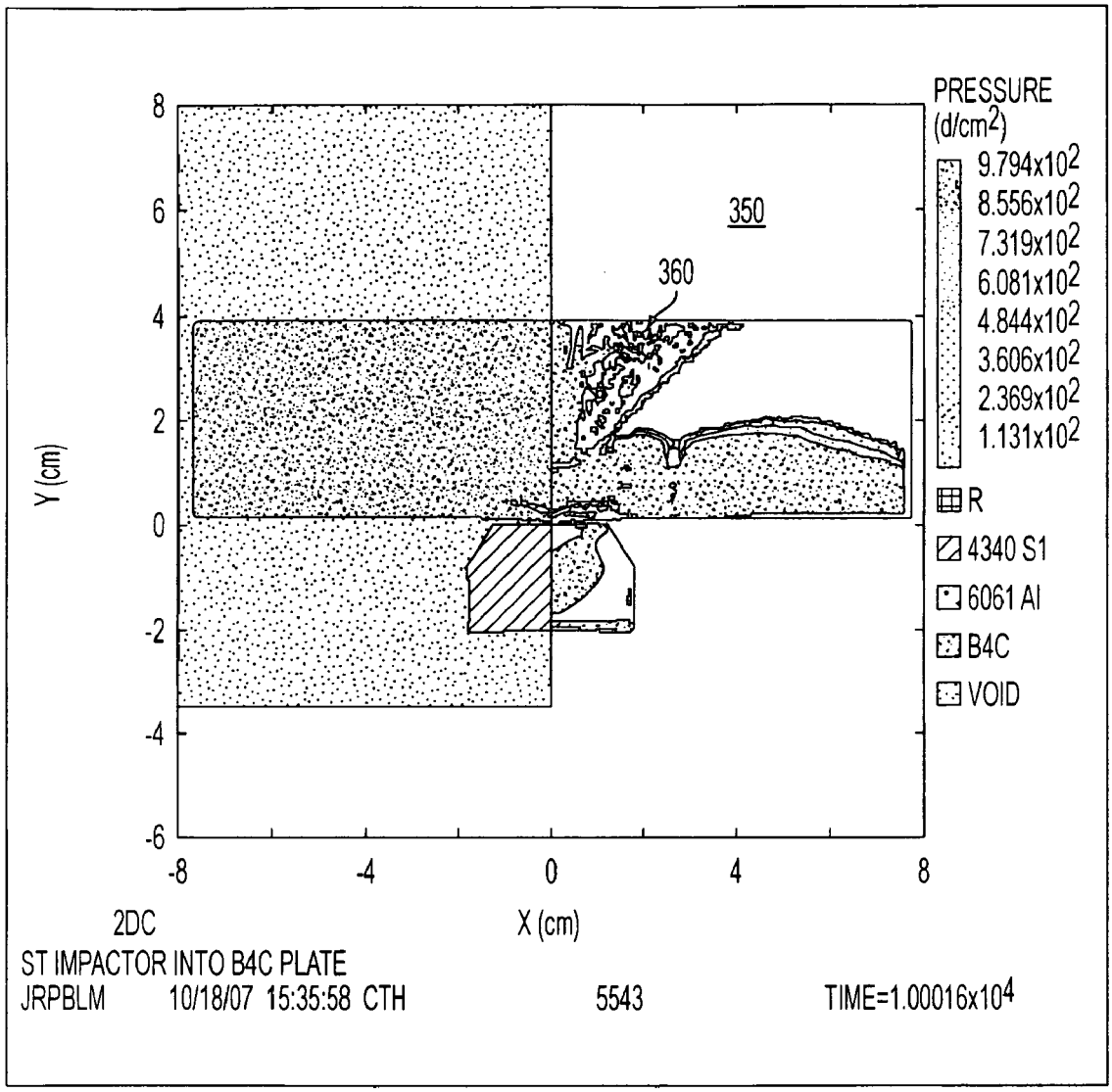
Figure 3C:
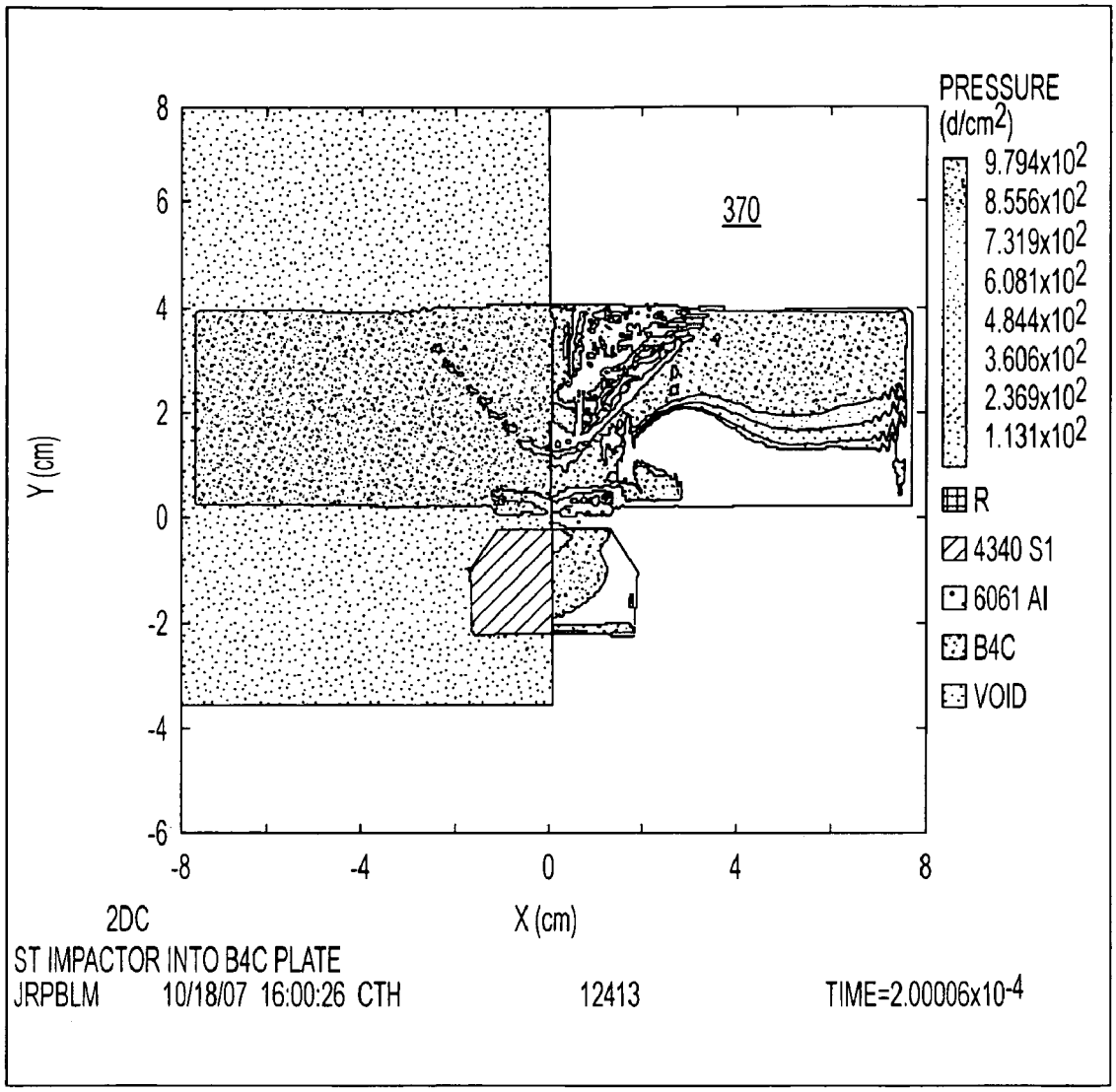
Figure 3D:
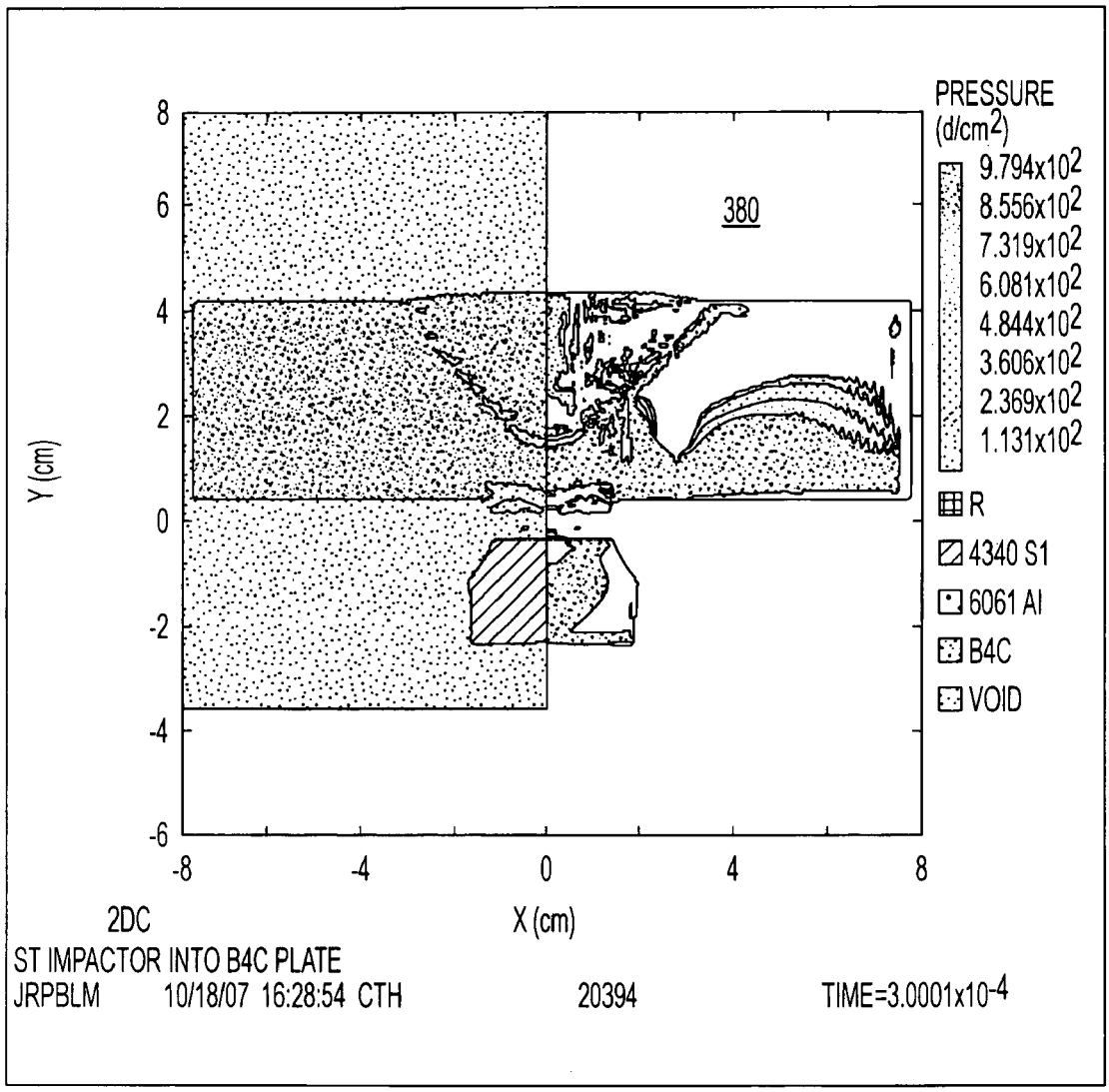

FIG. 3A illustrates contour plot results 300 for a solid $B_4C$ plate 310 at initial instant of impact prior to transfer of kinetic energy. A steel cone-cylinder projectile 320 strikes the plate 310, with materials denoted on the left side of the symmetry axis. The undeformed plate 330 represents the conditions upon collision with the projectile 320, with the stress scaling up to ~$10^8$ in baryes (or dy/cm$^2$=0.1 pascal=689.48 psi) on the right side in legend 340. FIG. 3B presents contour plot results 350 after 100 μsec from impact. A conical spall region 360 results from fragmentation of the plate 310. FIGS. 3C and 3D illustrate contour plot results 370 and 380 respectively after 200 μsec and 300 μsec from impact, showing the spall region becoming more pronounced.

Figure 4A:
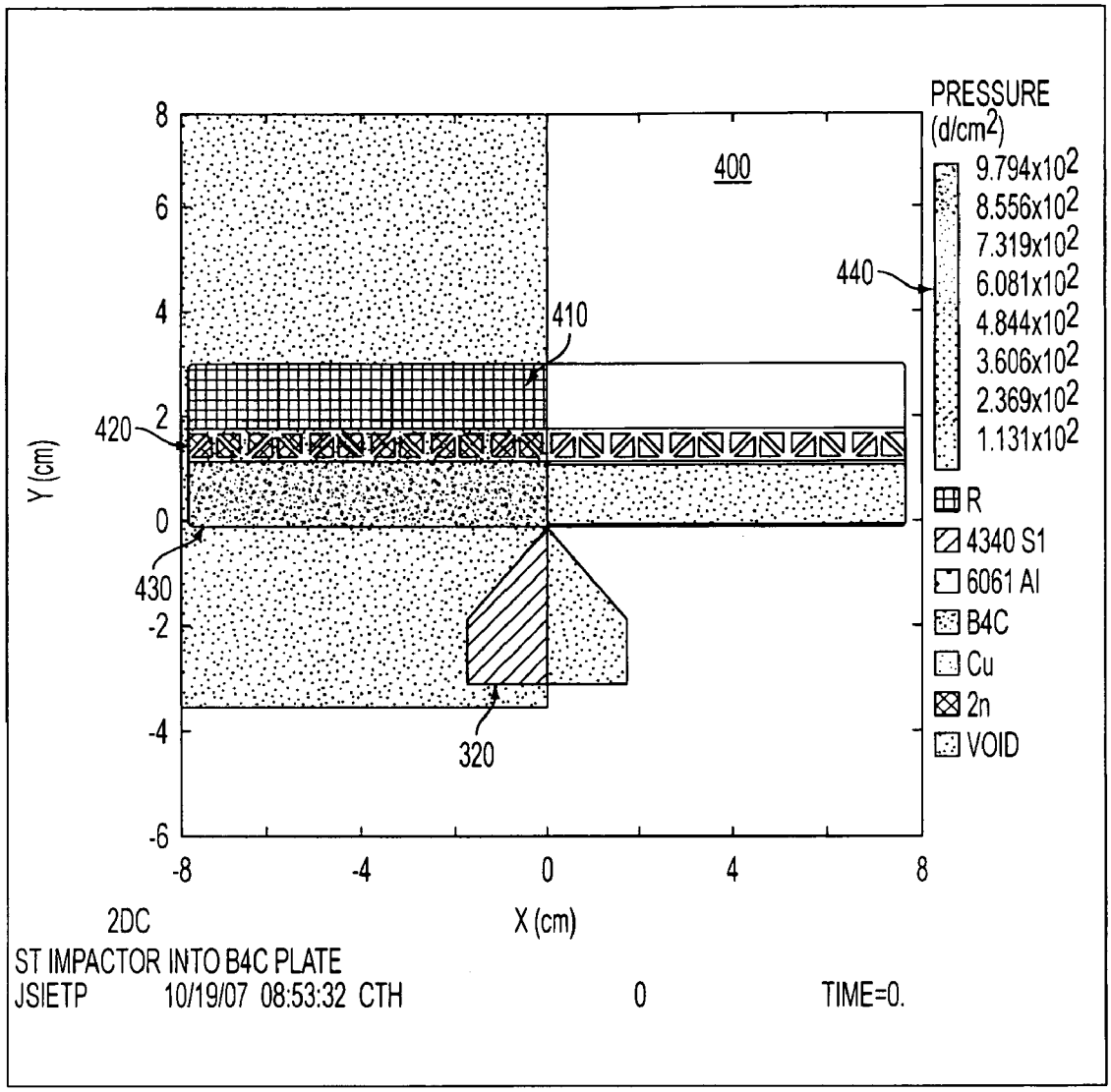
FIGS. 4A through 4D are elevation contour plots of time-elapse deformation of laminate body armor plate.
Figure 4B:
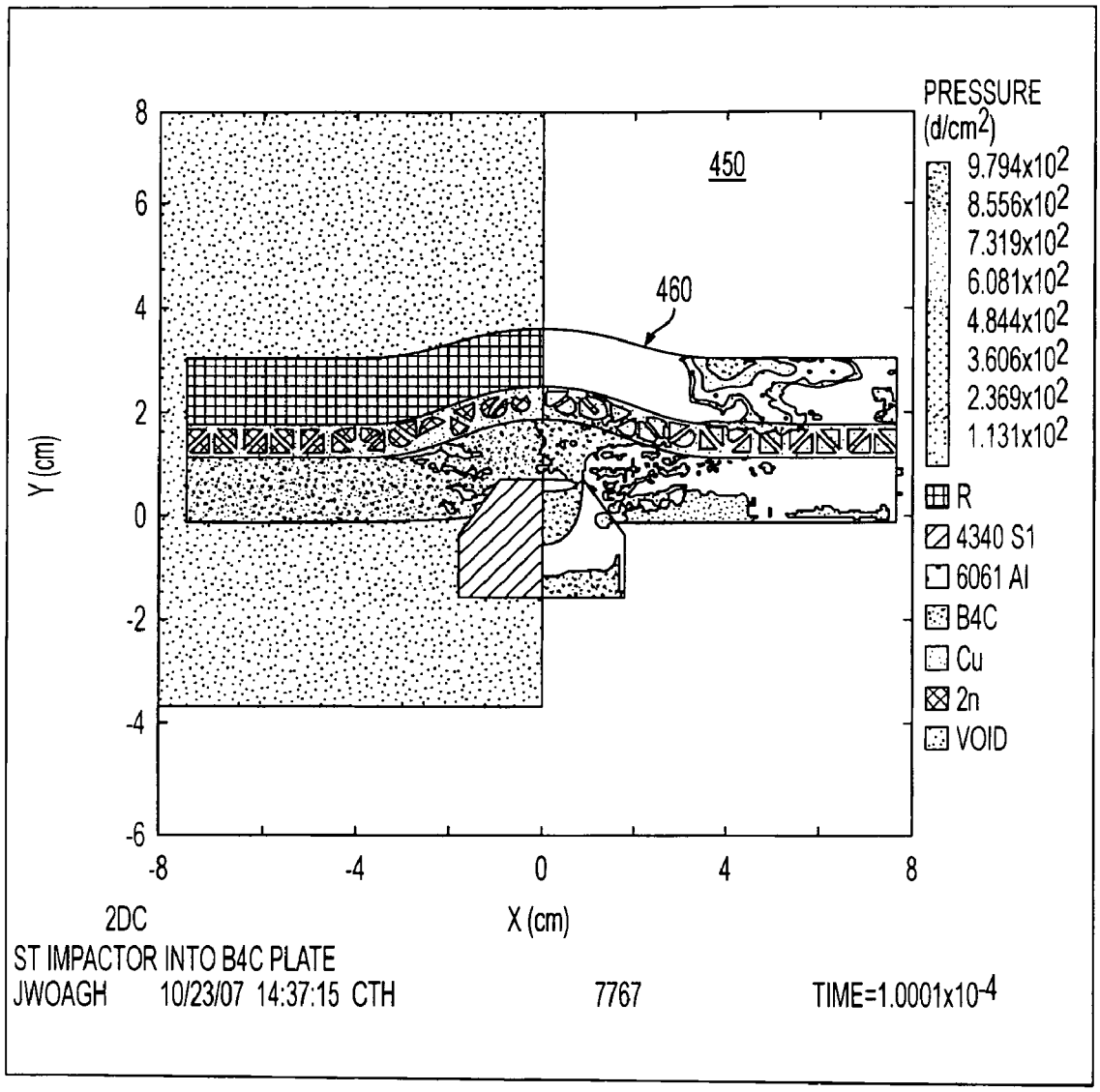

FIG. 4A reveals contour results 400 for a hybrid truss plate at initial instant of impact prior to transfer of kinetic energy. The plate includes a flexible liner 410, a copper-zinc sandwich truss 420 and an outer ceramic $B_4C$ layer 430. A steel cone-cylinder projectile 320 strikes the layer 430, with materials denoted on the left side of the symmetry axis, and the stress in Pascals (dy/cm$^2$, scaling up to ~$10^8$) on the right side in legend 440. FIG. 4B illustrates contour plot results 450 after 100 μsec from impact. A bulging depression 460 results from elongation of the liner 410 and the truss 420, as the ceramic layer 430 disintegrates from kinetic energy absorption.

Figure 4C:
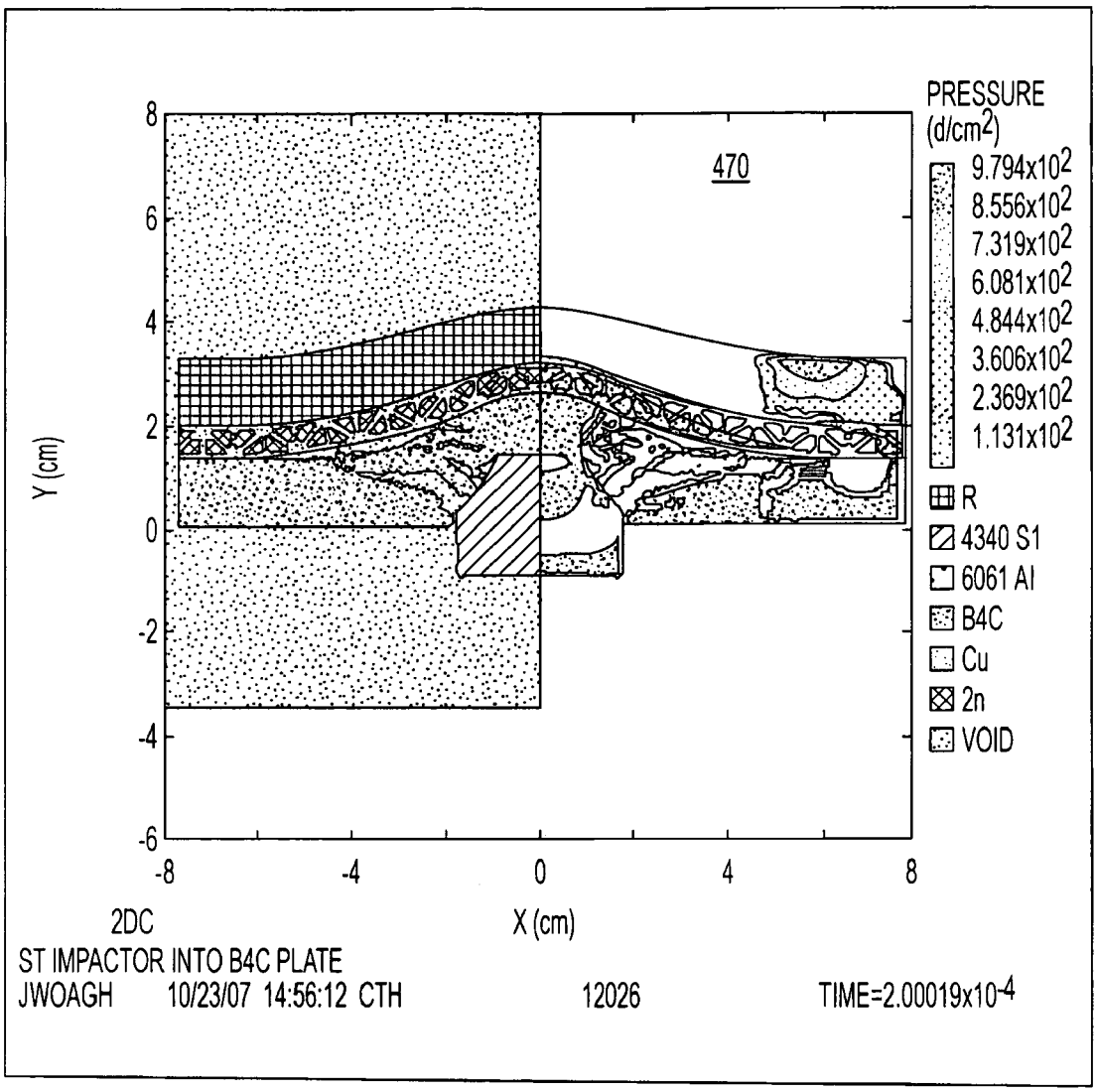
Figure 4D:
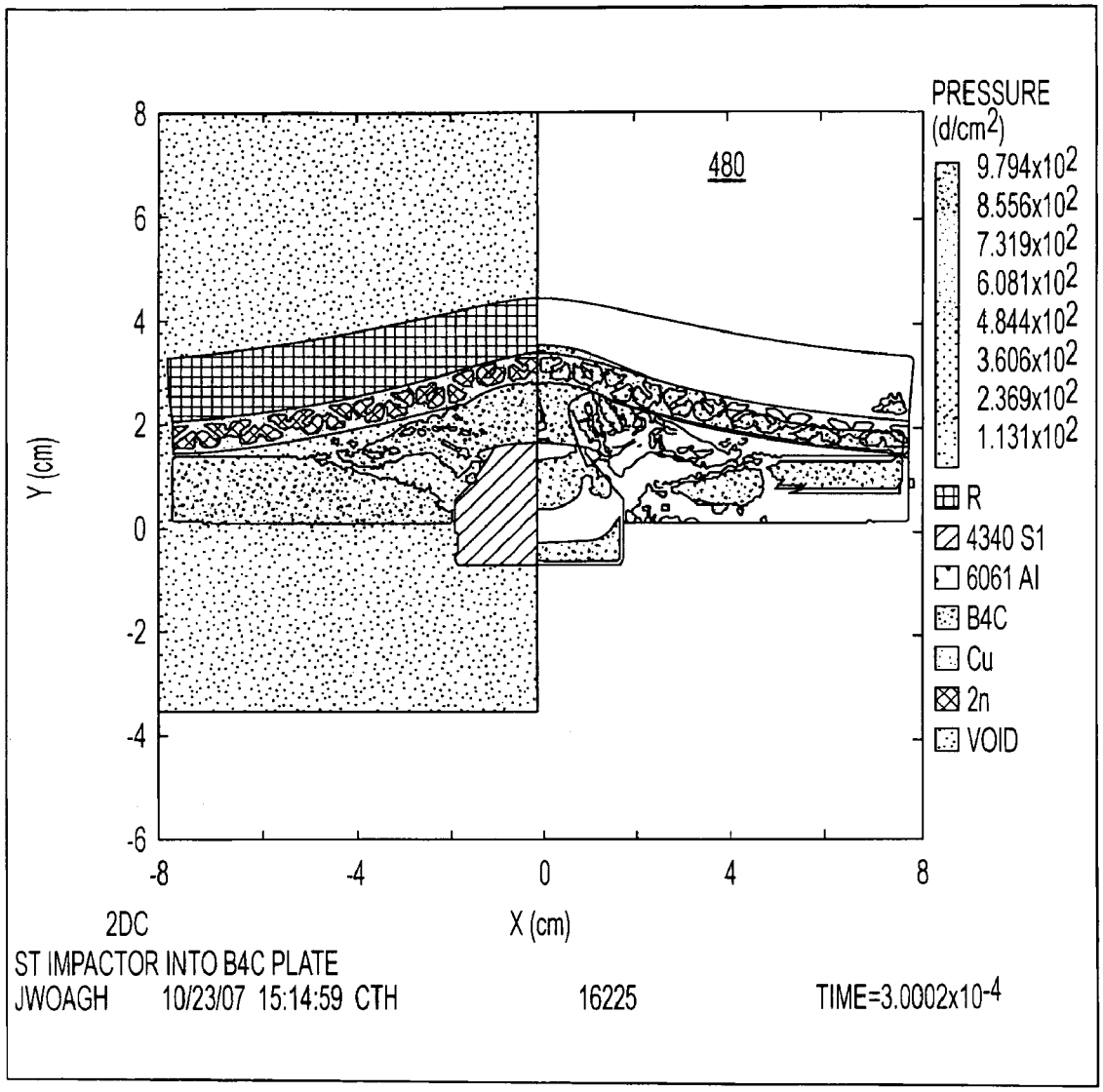

FIGS. 4C and 4D illustrate contour plot results 470 and 480 respectively after 200 μsec and 300 μsec from impact, showing the depression and distintegration regions becoming more pronounced. Thus, the laminated structure (with the truss representing a battery) distributes loads from kinetic impact and protects the human wearer from spalling fragmentation of the ceramic plates.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An armor plate for a body jacket, said plate comprising:

a substrate;

a ceramic cover disposed on said substrate, said cover having a plurality of thin cavities along said substrate; and a plurality of direct-current electrical power sources disposed within and corresponding to said cavities, each power source comprising a cell wherein each said cell of said plurality of electrical power sources includes a triple-layer sheet disposed within said cavities, said sheet comprising a first metal layer disposed on said substrate, an electrolyte layer disposed on said first electrode layer and a second electrode layer disposed between said electrolyte layer and said cover.

2. The plate according to claim 1, wherein said cover is composed of silicon carbide.

3. The plate according to claim 1, wherein each said cell of said plurality of electrical power sources includes a rectangular battery.

4. The plate according to claim 1, wherein each said cell of said plurality of electrical power sources includes a coin battery.

5. The plate according to claim 1, wherein said substrate is composed of a polymer.

* * * * *